US009267357B2

(12) United States Patent
Nguyen et al.

(10) Patent No.: US 9,267,357 B2
(45) Date of Patent: Feb. 23, 2016

(54) MULTI-COMPONENT DIFFUSER ASSEMBLY

(71) Applicant: Baker Hughes Incorporated, Houston, TX (US)

(72) Inventors: Hai H. Nguyen, Houston, TX (US); Marcus A. Avant, Kingwood, TX (US); Jeremy J. Guillory, Katy, TX (US); Donald P. Lauderdale, Cypress, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 424 days.

(21) Appl. No.: 13/763,370

(22) Filed: Feb. 8, 2013

(65) Prior Publication Data

US 2014/0224496 A1 Aug. 14, 2014

(51) Int. Cl.
*E21B 34/10* (2006.01)
*E21B 34/00* (2006.01)

(52) U.S. Cl.
CPC ..... *E21B 34/10* (2013.01); *E21B 2034/007* (2013.01)

(58) Field of Classification Search
None
See application file for complete search history.

(56) References Cited

U.S. PATENT DOCUMENTS

| | | | | |
|---|---|---|---|---|
| 3,109,493 | A * | 11/1963 | Carter | 277/337 |
| 2007/0089887 | A1* | 4/2007 | Gomez | 166/386 |
| 2011/0297254 | A1* | 12/2011 | Geddes et al. | 137/528 |
| 2013/0192833 | A1* | 8/2013 | Gano et al. | 166/302 |

* cited by examiner

*Primary Examiner* — Jennifer H Gay
*Assistant Examiner* — Caroline Butcher
(74) *Attorney, Agent, or Firm* — Steve Rosenblatt

(57) ABSTRACT

A diffuser assembly has pairs of split rings rotationally locked to each other in an alternating array with other pairs of split rings where adjacent pairs are responsive to pressure differential to be biased toward a sliding sleeve or the surrounding housing in an alternating pattern. The split rings are made to have an interference initial fit to the sleeve or housing and the splits on adjacent rings are offset while a relation of a projection to a depression between adjacent rings prevents relative rotation to keep the desired circumferential offset in the splits between adjacent rings. End tapers can bias adjacent pairs in opposed directions responsive to applied differential pressure. The rings are preferably metallic and can have a coating to facilitate relative sliding and enhance durability.

19 Claims, 3 Drawing Sheets

MULTI-COMPONENT DIFFUSER ASSEMBLY

FIELD OF THE INVENTION

The field of the invention is diffusers for seal protection from a velocity fluid flow and more particularly in applications for sliding sleeve valves or chokes in subterranean applications.

BACKGROUND OF THE INVENTION

Sliding sleeve valves are used to regulate formation flow into a production string or to balance flows from an interval. The housing has a port as does a sliding sleeve that can move axially within the housing. Normally the sleeve has a series of circumferentially spaced slots that travel past an isolation seal to initiate formation flow into the production tubing. The initial flow has to rush past the seal that is uphole from the housing inlet port. High initial velocities can damage the seal so that in the past diffusers have been used to protect the seal by reducing the fluid velocity that reaches the seal.

One attempt to slow down the fluid velocity has been to use a non-metallic ring, primarily made of PEEK and place the ring upstream from the seal being protected. The problem with such designs is that the material had service limits and the high velocity gas and temperatures in many applications limited the service life of such designs. Such single rings are illustrated in U.S. Pat. No. 6,722,439 as item 38. They were typically installed in an interference fit to the sliding sleeve on the inside and the valve housing on the exterior side. Other sliding sleeve valve designs that have similar components are U.S. Pat. Nos. 7,363,981; 7,921,915 and 7,575,058.

Metal ring diffusers were also used as alternatives to the PEEK designs. The problem with these rings is that they needed too much clearance for mounting purposes and let too much flow at high velocity get to the seal.

What is needed and addressed by the present invention is a diffuser assembly that has the durability feature with the ability to slow or stop the incoming high velocity fluid before it can reach the seal assembly and damage the seal. Thus an assembly of rings is provided that is energized by differential pressure to enhance an initial fit that is at least a clearance fit but preferably is an interference fit to the sliding sleeve on the inside and the surrounding housing on the outside. The rings are fabricated with a bias either toward the sleeve or the surrounding housing and are preferably disposed in alternating arrangements. Sloping surfaces are used in conjunction with pressure differential to further bias some rings inwardly and adjacent rings outwardly. In another variation the rings are split and matched in pairs that are biased out alternating with pairs biased to move in. The rings that move in a given direction can be split with the splits offset circumferentially and the relative position of the adjacent rings that move in a given direction prevented from relative rotation using a projection on one ring registering with a depression on an adjacent ring for each pair of rings that are designed to move either inwardly toward the sleeve or outwardly toward the surrounding housing. These and other features of the present invention will be more readily understood by those skilled in the art from a review of the detailed description of the preferred embodiment and the associated drawings while recognizing that the full scope of the invention is to be found in the appended claims.

SUMMARY OF THE INVENTION

A diffuser assembly has pairs of split rings rotationally locked to each other in an alternating array with other pairs of split rings where adjacent pairs are responsive to pressure differential to be biased toward a sliding sleeve or the surrounding housing in an alternating pattern. The split rings are made to have an interference initial fit to the sleeve or housing and the splits on adjacent rings are offset while a relation of a projection to a depression between adjacent rings prevents relative rotation to keep the desired circumferential offset in the splits between adjacent rings. End tapers can bias adjacent pairs in opposed directions responsive to applied differential pressure. The rings are preferably metallic and can have a coating to facilitate relative sliding and enhance durability.

DETAILED DESCRIPTION OF THE PREFERRED EMBODIMENT

Figure 1:
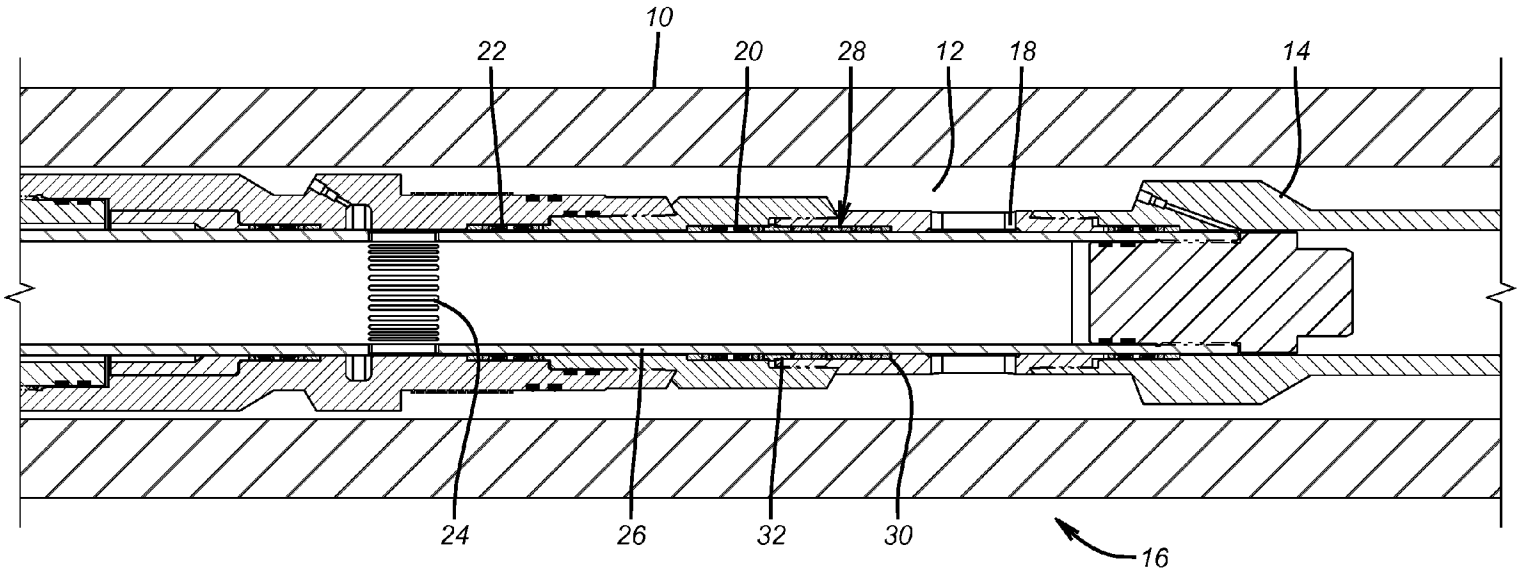
FIG. 1 is a section view of a sliding sleeve valve in the closed position showing the diffuser of the present invention.

FIG. 1 illustrates casing 10 which defines an annulus 12 around a valve housing 14 that is connected to production tubing that is not shown. The valve assembly 16 is shown in the closed position. The housing 14 has inlets 18. Primary seal 20 and backup seal 22 are disposed between the inlets 18 and the slots 24 on the sliding sleeve 26. Seals 20 and 22 are fixed in the housing 14 so that as the sliding sleeve 26 is moved either mechanically with a shifting tool (not shown) or hydraulically using control lines (not shown) the slots 24 will move past seal 20 so that the fluid can flow from the annulus 12 into inlets 18 and to or past the diffuser assembly 28 and into slots 24 of the sliding sleeve 26 and on up to the surface. The diffuser assembly 28 is axially retained between radial surface 30 on housing 14 and top ring 32, a part of which can be seen in FIG. 2.

Figure 2:
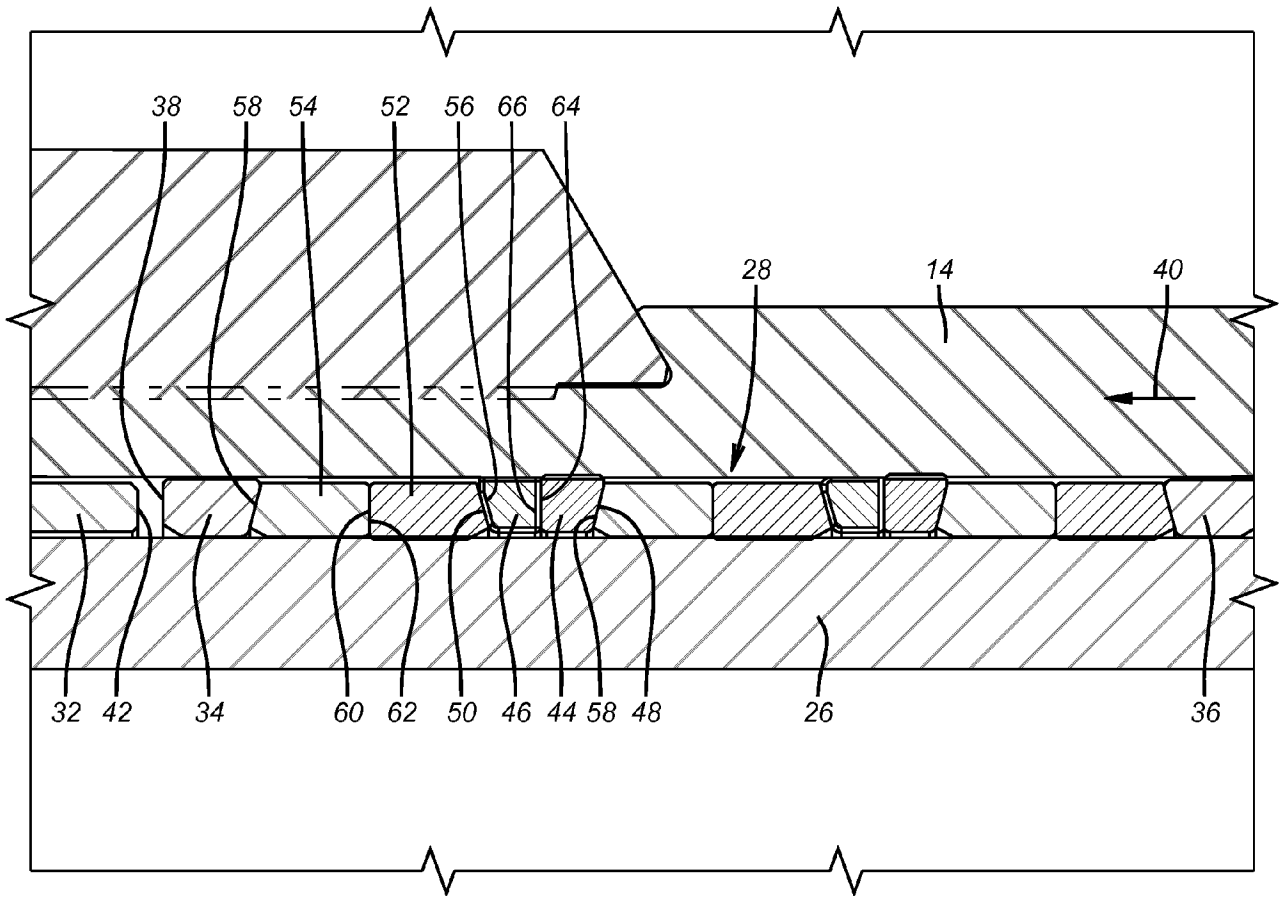
FIG. 2 is a close up view of the diffuser shown in FIG. 1.

FIG. 2 is a close up view of the diffuser assembly 28 shown in FIG. 1. The assembly 28 is bookended by rings 34 and 36 with each having an exterior radial surface such as 38 shown on ring 34. Once the slots 24 get past seal 20 pressure in the annulus 12 represented by arrow 40 enters the annular gap between the sliding sleeve 26 and the housing 14. The force from pressure represented by arrow 40 moves all the illustrated components axially so that initially radial surface 38 abuts an opposing and stationary surface 42 on ring 32.

There are pairs of rings 44 and 46 with sloping end walls 48 and 50 that face away from each other. Rings 44 and 46 are essentially mirror image trapezoidal shapes in section. Adjacent the ring pair 44 and 46 is another ring pair 52 and 54. Rings 52 and 54 have opposed end surfaces 56 and 58 respectively so that on application of an axial force from pressure represented by arrow 40 the diffuser assembly 28 shifts axially and opposed surfaces 48 and 58 on one side and surfaces 50 and 56 on the other side create a net radial outward force on rings 44 and 46 and a net radial inward reaction force on rings 52 and 54. Rings 52 and 54 are essentially mirror image trapezoidal shapes in section. It should be noted that rings 44 and 46 are manufactured to preferably be in an interference fit against the housing 14 on assembly although a clearance fit can also be used. The application of pressure represented by arrow 40 simply pushes rings 44 and 46 harder against the housing 14. Similarly, ring pairs 52 and 54 are fabricated to have an initial interference fit to the sleeve 26 although a clearance fit is also possible. Force created by pressure represented by arrow 40 enhances the contact force to the sleeve 26 for the ring pairs 52 and 54. Preferably the pattern on rings that are forced toward the housing 14 is alternated with a ring pair that is forced against the sleeve 26.

It should be noted that ring pair 52 and 54 have opposed contacting radial surfaces 60 and 62 that are preferably perpendicular to the axis of the sleeve 26. Similarly, ring pair 44 and 46 has opposed radial surfaces 64 and 66 that are preferably perpendicular to the axis of the sleeve 26. The surface pairs 50 and 56 on one side and 48 and 58 on the other side of the pair of rings 44 and 46 are shown at a preferred angle of about 15 degrees to a plane perpendicular to the axis of the sleeve 26 but a range of 0-45 degrees is contemplates. At 0 degrees there is no radial sliding component of force while at 45 degrees such radial force is maximized. The various rings are preferably made of a softer material than the housing 14 or the sleeve 26 to avoid scoring either of those opposing surfaces. The rings can also be coated with a lubricious material to facilitate radial movement and in that case can also be of a material that is harder than the housing 14 or the sleeve 26.

Figure 3:
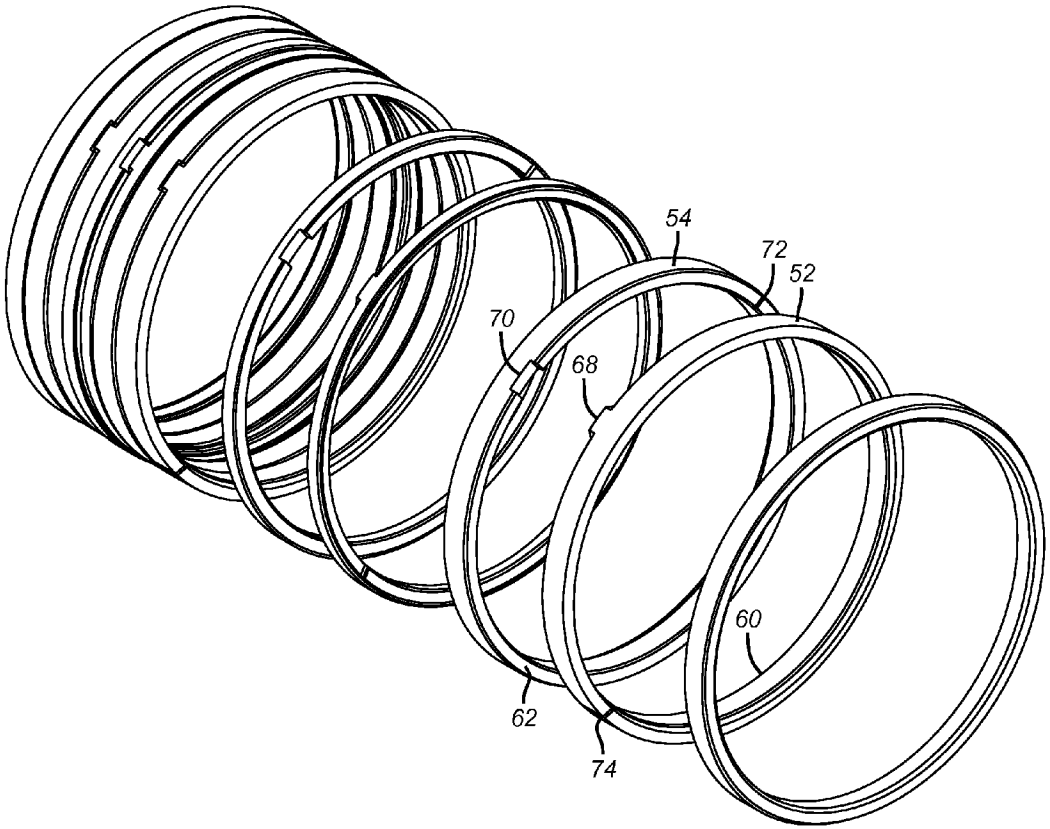
FIG. 3 is an exploded perspective view of the ring array that comprises the diffuser of the present invention.

FIG. 3 illustrates ring pairs such as 44 and 46 or 52 and 54 can be rotationally locked to each other using a combination of a projection 68 on ring 52 mating with a depression 70 on the ring 54. The locking mechanism of projection with depression can be reversed and other types of rotational locks can be used within the spirit of the invention.

The rotational locking serves to keep splits 72 and 74 on adjacent rings circumferentially offset. Adjacent splits are preferably kept 180 degrees apart. End rings 34 and 36 are preferably not split but optionally can also have a split. While the figures show rotational locking only between pairs such as 44 and 46 or 52 and 54, those skilled in the art can appreciate that ring pairs that move toward housing 14 can be optionally rotationally locked to ring pairs that move toward sleeve 26 which in effect locks all the split rings between end rings 34 and 36 together rotationally.

As an alternative to having a split 72 or 74 which can incorporate butted ends cut in a plane going through the ring axis or on a skew so that the cut ends overlap, the ring can simply have a flexible portion in a complete ring to achieve the same effect. A part of the ring can have a sinusoidal component or an alternating bend pattern that allows the diameter to increase or decrease without undue resistance. The flexible portions can also be circumferentially offset and maintained in their relative positions in the manner described above. In some respect the locking feature of projection and depression can integrate some diametric flexibility that can allow elimination of the split or use in conjunction with the splits in the rings. If the splits in the rings are eliminated in favor of flexible portions on the rings then the rotational locking can be optionally omitted.

As another option the rings can be made of a shape memory alloy which allows rapid assembly but on exposure to well fluids or other heat sources before initially moving the sliding sleeve 26 the rings can revert to an original shape that can have some rings moving toward sleeve 26 and alternating rings moving in an opposite direction toward the housing 14. In that manner initial clearances on assembly are closed before operation of the sleeve 26.

Those skilled in the art will appreciate that the described diffuser assembly can slow down or stop migrating fluid that can potentially damage the seal in a sliding sleeve valve. The assembly uniquely has multiple components. More specifically the components can be manufactured with a bias toward the sleeve or the housing and preferably in alternating patterns. The bias can either be created in the manufacture of the rings or the shape can change using shape memory material exposed to a temperature above a critical temperature to gain at least a clearance fit but preferably an interference fit before the valve is opened. If the rings are made of shape memory alloy they may not need to have a split but can have a flexible segment. Additionally, ring pairs need not be used as the reconfiguration of each ring can build into that ring movement in the desired direction toward the housing or the sleeve on an alternating basis after the critical temperature is reached. The rings can be shaped to create radial forces toward the sleeve or the housing in response to an axial force created by fluid as the valve is opened. The rings can be split for rapid assembly with the splits circumferentially offset and the relative positions held by a locking feature so that adjacent pairs can be rotationally locked to each other. The split or some flexibility in a whole ring structure also allows the rings to compensate for dimensional tolerances in the moving sleeve during operation of the valve. Optionally all the pairs whether urged toward the sleeve or toward the housing can be rotationally locked to each other or to end rings or an internal housing shoulder on opposed ends of the assembly. Although ring pairs are illustrated as moving radially in a given direction toward the housing or the sleeve one or more rings can be used to move in a given radial direction instead of the pairs illustrated in the FIGS.

While the application in which the diffuser assembly is discussed in a sliding sleeve valve, other applications where an annular space is sealed and the seal is exposed to fluid flow that can potentially damage the seal can be also situations where the diffuser assembly can be deployed.

The above description is illustrative of the preferred embodiment and many modifications may be made by those skilled in the art without departing from the invention whose scope is to be determined from the literal and equivalent scope of the claims below:

We claim:

1. A diffuser assembly for a seal exposed to fluid flow in an annular space, comprising:

a mandrel surrounded by a housing defining an annular space therebetween;

said mandrel comprising a sleeve having at least one sleeve opening, said sleeve opening selectively aligned with a housing opening for flow through said housing;

at least one seal in said annular space;

a diffuser assembly in said annular space between said seal and said housing opening further comprising a plurality of abutting stacked rings spanning without sealing said annular space wherein pressure in said annular space from said sleeve opening passing said at least one seal exerts an axial force in said annular space in a direction of a longitudinal axis of said housing creating opposed radial movement of said abutting stacked rings.

2. The assembly of claim 1, wherein:

said rings are disposed in an alternating pattern of contact with said housing and contact with said sleeve.

3. The assembly of claim 2, wherein:

said contact with said housing or said sleeve is at least a clearance fit on initial assembly into said annular space.

4. The assembly of claim 2, wherein:

said rings are shaped to respond to an axial pressure induced force in said annular space to move radially in opposed directions.

5. The assembly of claim 4, wherein:

at least some of said rings are split.

6. The assembly of claim 5, wherein:

adjacent rings each have a split and the splits in said adjacent rings are circumferentially offset.

7. The assembly of claim 6, wherein:

adjacent rings with splits are rotationally locked.

8. The assembly of claim 1, wherein:

said rings are configured to move radially toward said housing in pairs by movement of an adjacent pair of rings moving radially in an opposite radial direction toward said sleeve.

9. The assembly of claim 1, wherein:

at least some of said rings are split.

10. The assembly of claim 9, wherein:

adjacent rings each have a split and the splits in said adjacent rings are circumferentially offset.

11. The assembly of claim 10, wherein:

adjacent rings with splits are rotationally locked.

12. The assembly of claim 11, wherein:

said rotational locking is accomplished with a projection in one ring extending into a depression in an adjacent ring.

13. The assembly of claim 9, wherein:

said split defines ends that abut or overlap.

14. The assembly of claim 1, wherein:

an axial compressive force on said rings moves alternating ring pairs radially in opposed directions.

15. The assembly of claim 1, wherein:

said rings are continuous with a flexible region to facilitate movement toward said housing or toward said sleeve.

16. The assembly of claim 1, wherein:

said rings have an initial clearance to said housing or said sleeve on assembly;

said rings are made from a shape memory alloy such that on exposure to heat above a critical temperature said clearance to said housing and to said sleeve respectively, for adjacent rings or pairs of adjacent rings, is reduced or eliminated.

17. The assembly of claim 1, wherein:

said rings are disposed in alternating pairs where each pair has mirror image trapezoidal cross-sections with non-sloping contacting surfaces in between and outer opposed end sloping faces, said outer opposed sloping surfaces of adjacent pairs are in sliding contact for movement in opposed radial directions.

18. The assembly of claim 1, wherein:

said rings are made of a softer material than said housing or said sleeve.

19. The assembly of claim 1, wherein:

said rings are exposed metal or metal coated with a lubricious material.

* * * * *